United States Patent [19]

Hosoyamada et al.

[11] Patent Number: 4,753,831

[45] Date of Patent: Jun. 28, 1988

[54] CARDBOARD CONTAINER WITH ANTI-SLIP PROPERTY

[75] Inventors: Gen-ichi Hosoyamada, Shiranuka; Keiichi Kobayashi, Matsudo; Hiroshi Matsuoka, Musashino, all of Japan

[73] Assignees: Otsuka Foods Co., Ltd.; Cemedine Co., Ltd.; Honshu Container Co., Ltd.; Honshu Seishi Kabushiki Kaisha, all of Japan

[21] Appl. No.: 827,398

[22] Filed: Feb. 10, 1986

[51] Int. Cl.[4] ..... B65D 5/62

[52] U.S. Cl. ..... 428/35; 428/305.5; 428/313.5; 220/69; 229/915

[58] Field of Search ..... 383/32; 229/915, DIG. 11; 220/69, 455; 428/35, 305.5, 313.5

[56] References Cited

U.S. PATENT DOCUMENTS

| | | | |
|---|---|---|---|
| 2,643,048 | 6/1953 | Wilson | 383/32 |
| 3,246,831 | 4/1966 | Teicher | 383/32 |
| 3,283,992 | 11/1966 | Hanson | 229/DIG. 11 |
| 3,490,583 | 1/1970 | Cook | 220/69 |
| 3,615,972 | 10/1971 | Morehouse et al. | 156/79 |
| 4,287,308 | 9/1981 | Nakayama et al. | 521/53 |
| 4,477,518 | 10/1984 | Cremona et al. | 428/313.5 |

FOREIGN PATENT DOCUMENTS

| | | |
|---|---|---|
| 26524 | 9/1963 | Japan . |
| 113338 | 7/1981 | Japan . |

*Primary Examiner*—John E. Kittle
*Assistant Examiner*—James J. Seidleck
*Attorney, Agent, or Firm*—Parkhurst & Oliff

[57] ABSTRACT

A cardboard container with anti-slip property is disclosed. It has a synthetic resin layer formed of thermoplastic synthetic resin fine hollow particles of 5 to 50 microns in diameter containing one or more of an inert gas, an active gas, a nonvolatile liquid and a volatile liquid coupled by a synthetic resin component exhibiting an action of a binder. The synthetic resin layer is formed on the outer surface of at least one of bottom and upper walls of the container on the entire surface or a portion of the surface as a spot, a lattice or a stripe. Thus, particular means are not necessary to handle the cardboard container such as packing with a film or binding with bands after stacking a plurality of containers. The anti-slipping effect remains even after the stacked containers are sorted and transferred.

10 Claims, 3 Drawing Sheets

CARDBOARD CONTAINER WITH ANTI-SLIP PROPERTY

BACKGROUND OF THE INVENTION

This invention relates to a cardboard container with anti-slip property and, more particularly, to a cardboard container having a function for preventing a slip among the containers for causing stacked containers to collapse in case of working such as a transportion for stacking and transporting out and in the containers.

When products packed by cardboard containers and hence corrugated fiberboard boxes are transported to a remote district, the containers are carried out and in, and transported in the state that the containers are stacked in multiple stages. The containers will slip due to a shock applied to the containers or an inclination of the loaded containers during the work to cause the stacked containers to be collapsed. Thus, a plurality of containers are in general stacked. The stacked containers are packed by mechanical means such as by synthetic resin film or sheet, or bound by bands, or fixed by a wooden frame, or temporarily bonded by bonding means such as with an adhesive between the upper and the lower containers so as to prevent the stacked containers from collapsing. However, the mechanical means of the former method of stacking has such a drawback that they involve not only complicated operations, but must add additional anti-slip means in case the packed containers are unbound to be sorted into loads to be shipped. The bonding means of the latter also has such a disadvantage that they not only involve troublesome operations due to the bonding work in the loading work but the bonding effect is lost after unpacking.

SUMMARY OF THE INVENTION

Accordingly, it is an object of this invention to provide a cardboard container which it is not necessary to handle by particular means such as packing with a film or binding with bands after stacking a plurality of containers. They can perform entirely the same anti-slipping effect even after the stacked containers are sorted and transferred. They are constructed with a synthetic resin layer formed of thermoplastic synthetic resin fine hollow particles of 5 to 50 micron in diameter containing one or more of inert gas, active gas, nonvolatile liquid and volatile liquid coupled by synthetic resin component exhibiting the activity of a binder is formed on the entire or partly in a spot, a lattice or stripe on the outer the bottom or upper walls of the container.

The foregoing object and other objects as well as the characteristic features of the invention will become more fully apparent and more readily understandable from the following description and the appended claims when read in conjunction with the accompanying drawings.

DESCRIPTION OF THE PREFERRED EMBODIMENTS

Embodiments of a cardboard container constructed according to this invention will now be described in detail with reference to the accompanying drawings.

Figure 1:
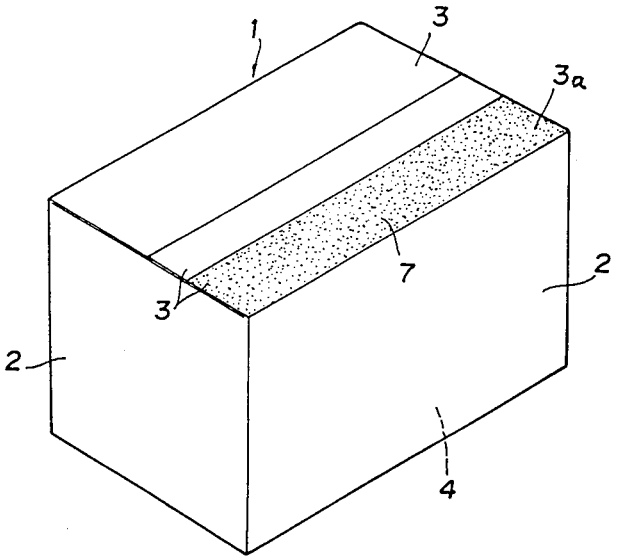
FIG. 1 is a perspective view of a corrugated fiberboard box as an embodiment of a cardboard container having anti-slip property according to this invention.

A cardboard container 1 of this invention shown in FIG. 1 is a corrugated fiber board box which has body walls 2, an upper wall 3 of a cover, and a bottom wall 4. A synthetic resin layer 7 formed of thermoplastic synthetic resin fine hollow particle groups 5, 5, . . . of 5 to 50 microns in diameter shown in FIG. 2, containing one or more of an inert gas, active gas, a nonvolatile liquid and volatile liquid coupled by a synthetic resin component 6 exhibiting an action of a binder. The synthetic resin layer 7 is formed on the outer surface of a portion 3*a* of the upper wall 3 of a cover in the container 1. The synthetic resin layer 7 performs the function of anti-slipping the container 1.

Figure 2:
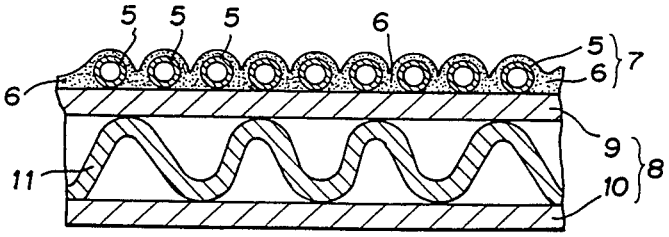
FIG. 2 is a partially enlarged sectional view of the cardboard container of FIG. 1.

In FIG. 2, the portion designated by reference numeral 8 is a corrugated fiberboard formed by bonding and laminating two paper layers 9 and 10 above and below a wavy sheet 11 as a constituent material of a corrugated fiber board box of a base of the cardboard container 1.

The cardboard container 1 exemplified as an embodiment of this invention has the synthetic resin layer 7 partly formed on the outer surface of the upper wall 3 as part of the container 1. However, the layer 7 may be formed on at least one of the entire outer surfaces of the bottom and top walls 4 and 3 of the container 1, or it may be formed in a spot, a lattice or a striped shape.

The synthetic resin layer 7 of the cardboard container of this invention is a synthetic resin layer formed of thermoplastic synthetic resin fine hollow particle groups 5, 5 . . . of 5 to 50 micron in diameter containing one or more of an inert gas, an active gas, a nonvolatile liquid and volatile liquid coupled with the synthetic resin component 6 exhibiting an action of a binder. It is readily formed by coating and drying. It may be applied by printing means, or a coating means such as a roller, a curtain coater or a sprayer may be used to apply a coating in which the thermoplastic synthetic resin fine hollow particle groups are substantially uniformly mixed and dispersed in water dispersant of the synthetic resin or an organic solvent of a film forming component exhibiting an action of a binder on a predetermined portion in the cardboard container. The synthetic resin layer 7 may be coated and dried directly on the predetermined portion of the container, or on the predetermined portion of a blank sheet immediately before the step of forming the container or further by means such as coating and drying on the predetermined portion of the paper before a laminating step where producing laminated paper is used for forming the container.

The thermoplastic synthetic resin fine hollow particles utilize, for example, a content of one or more of an inert gas, active gas, a nonvolatile liquid or a volatile liquid made of ethane, ethylene, propane, butane, isobutane, butene, acetylene, or heptane, chlorofluorocarbon such as $CCl_3F$, $CCl_2F_2$, $CClF_3$, tetraalkylsilane such as tetramethylsilane, trimethylethylsilane, trimethylisopropylsilane, petroleum ether, water, nitrogen or carbon dioxide gas contained in fine hollow particles formed of thermoplastic synthetic resin of polymer or copolymer such as, for example, vinylidene chloride, acrylonitrile, vinyl chloride, acrylic acid ester, methacrylic acid ester, styrene, vinyl acetate. The thermoplastic synthetic resin and the content which form the fine hollow particles are so selected as not to dissolve or swell the thermoplastic synthetic resin which forms the fine hollow particles with the content.

Figure 3A:
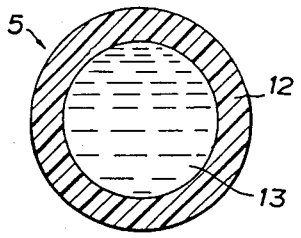
FIGS. 3(*a*) and 3(*b*) are enlarged sectional views of ultrafine hollow particles in a synthetic resin layer of the container having the anti-slip property according to this invention.
Figure 3B:
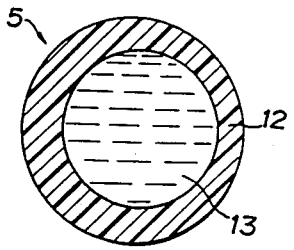

The synthetic resin component 6 of the film forming component in the coating agent used to form the synthetic resin layer 7 exhibits the action of a binder in the synthetic resin layer 7, and utilizes ordinary synthetic resin such as, for example, vinyl acetate resin, ethylene.-vinyl acetate resin, acrylic resin, styrene resin, vinyl chloride resin, vinyl acetate acrylic resin, vinyl chloride.vinyl acetate layer, ethylene.acrylic resin, vinylidene chloride resin, polyester resin, polyurethane resin, chloroprene polymer, nitrile rubber, styrene-butadiene copolymer, methacrylic.styrene copolymer, etc. Further, the thermoplastic synthetic resin fine hollow particles 5, 5, . . . of the synthetic resin layer 7 are formed, as exemplified in FIG. 3, formed at the wall film 12 of thermoplastic synthetic resin, and are fine hollow particles of 5 to 50 micron in diameter containing one or more of an inert gas, an active gas, a nonvolatile liquid and a volatile liquid 13 in a portion surrounded by the wall film 12, i.e., the interior, and utilizes the thermoplastic polymer particles disclosed, for example, in Japanese Patent Publication No. 26524/1967 or Japanese Patent Laid-open No. 113338/1981 as it is. The ratio of the synthetic resin component 6 of the film forming component exhibiting an action of a binder to the thermoplastic synthetic resin fine hollow particles 5 in the synthetic resin layer 7 is preferably approx. 10 to 500 wt. parts of the fine hollow particles to 100 wt. parts of the synthetic resin component according to the size of the fine hollow particles 5.

The thermoplastic synthetic resin fine hollow particles 5 in the synthetic resin layer 6 of the cardboard container of this invention are softened, when exposed to a hot atmosphere, within the thermoplastic synthetic resin for forming the hollow particles 5, and the inert gas, active gas nonvolatile liquid or volatile liquid contained therein is exhausted. Thus, when the synthetic resin layer 7 is repeatedly subjected to frictions and it loses the durability of its anti-slipping effect of durability. Accordingly, in case of forming the synthetic resin layer 7, it must avoid heat to a temperature at which the fine hollow particles are swelled by the inert gas, active gas nonvolatile liquid or volatile liquid 13 contained therein due to the softening of the thermoplastic synthetic resin of the fine hollow particles 5 in the step of drying after coating the coating agent.

The coating agent used to form the synthetic resin layer 7 utilizes the mixture or dispersion of the thermoplastic synthetic resin fine hollow particles of 5 to 50 micron in diameter containing one or more of the inert gas, active gas, nonvolatile liquid or volatile liquid in the water dispersant or organic solvent of the ordinary thermoplastic synthetic resin of the film forming component as described above, and, in this case, the thermoplastic synthetic resin fine hollow particles must be selected so as not to be dissolved in the water dispersant or the organic solvent of the thermoplastic synthetic resin mixed with the hollow particles.

The cardboard container having the anti-slip property of this invention will be further described with respect to examples.

EXAMPLE 1

A coating agent which contained water dispersant of 50 wt.% of solid component containing the following:

(1) 100 wt. parts of ethylene.vinylacetate copolymer emulsion (solid content)
Particle diameter: 0.7 micron
Nonvolatile content: 50%
Viscosity: 500 cps (2) 100 wt. parts of fine hollow particles of vinylidene chloride
Content: butane
Diameter of particle: 10 to 20 micron was coated on the entire top and bottom surfaces of a corrugated fiberboard box having 34 cm of longitudinal size, 28.5 cm of lateral size and 14.0 cm of height at a ratio of 3.5 g (solid content)/$m^2$, dried at room temperature, thereby obtaining the cardboard container (I) of this invention.

EXAMPLE 2

A coating agent which contained the following:

(1) 100 wt. parts of ethylene.vinylacetate copolymer emulsion (solid content)
Particle diameter: 0.65 micron
Nonvolatile content: 55%
Viscosity: 6000 cps (2) 100 wt. parts of fine hollow particles of vinylidene chloride
Content: butane
Diameter of particle: 10 to 20 micron (3) 20 wt. parts of water was coated on the entire top surface of the same corrugated fiberboard box as that utilized in the Example 1 at a ratio of 3.5 g (solid content)/$m^2$, dried at room temperature, thereby obtaining the cardboard container (II) of this invention.

EXAMPLE 3

The same coating agent as that in the Example 1 was coated on the entire top surface and in a stripe shape of 15 mm in width at an interval of 5 mm over the entire bottom surface of the same box as that utilized in the Example 1 at a rate of 3.5 g (solid content)/$m^2$ of the coated portion, and dried at room temperature, thereby obtaining the cardboard container (III) of this invention.

EXAMPLE 4

The same coating agent as that in the Example 1 was coated in a stripe shape of 15 mm in width at an interval of 5 mm over the entire top and bottom surfaces of the same box as that utilized in the Example 1 at a rate of 3.5 g (solid content)/$m^2$ of the coated portion, and dried at room temperature, thereby obtaining the cardboard container (IV) of this invention.

EXAMPLE 5

The same coating agent as that in the Example 1 was coated in a stripe shape of 15 mm in width at an interval of 5 mm over the entire top surface of the same box as that utilized in the Example 1 at a rate of 3.5 g (solid content)/$m^2$ of the coated portion, and dried at room temperature, thereby obtaining the cardboard container (V) of this invention.

EXAMPLE 6

A coating agent which contained the following (1) 100 wt. parts of acrylic acid ester emulsion (solids content)
Particle diameter: 1 micron
Nonvolatile content: 50%
Viscosity: 2000 cps (2) 100 wt. parts of fine hollow particles of vinylidene chloride
Content: butane
Diameter of particle: 15 to 30 micron (3) 20 wt. parts of water was coated on the entire top and bottom surfaces of the same corrugated fiberboard box as that utilized in the Example 1 at a ratio of 3.5 g (solid content)/m$^2$, dried at room temperature, thereby obtaining the cardboard container (VI) of this invention.

EXAMPLE 7

A coating agent which contained the following:

(1) 100 wt. parts of ethylene.vinyl acetate copolymer emulsion (solid content)
Particle diameter: 0.7 micron
Nonvolatile content: 55%
Viscosity: 5500 cps (2) 150 wt. parts of fine hollow particles of vinylidene chloride.acrylonitrile copolymer
Content: isobutane
Diameter of particle: 10 to 20 micron with water dispersant of 52 wt.% of solid content was coated on the entire top and bottom surface of the same corrugated fiberboard box as that utilized in the Example 1 at a ratio of 3.5 g (solid content)/m$^2$, dried at room temperature, thereby obtaining the cardboard container (VII) of this invention.

EXAMPLE 8

A coating agent which contained the following:

(1) 100 wt. parts of ethylene.vinyl acetate copolymer emulsion (solid content)
Particle diameter: 0.7 micron
Nonvolatile content: 55%
Viscosity: 1500 cps (2) 80 wt. parts of fine hollow particles of methacrylic acid methyl acrylonitrile copolymer
Content: isobutane
Diameter of particle: 10 to 30 micron with water dispersant of 50 wt.% of solid content was coated on the entire top and bottom surfaces of the same corrugated fiberboard box as that utilized in the Example 1 at a ratio of 3.5 g (solid content)/m$^2$, dried at room temperature, thereby obtaining the cardboard container (VIII) of this invention.

EXAMPLE 9

A coating agent which contains the following:

(1) 100 wt. parts of ethylene.vinyl acetate copolymer emulsion (solid content)
Particle diameter: 0.7 micron
Nonvolatile content: 55%
Viscosity: 5500 cps (2) 150 wt. parts of fine hollow particles of vinylidene chloride.acrylonitrile copolymer with water dispersant of 49 wt.% of solid content is coated on the entire top and bottom surfaces of a corrugated fiberboard box at a ratio of 3.5 g (solid content)/m$^2$, and dried at room temperature, thereby obtaining the cardboard container (IX) of this invention.

Figure 4:
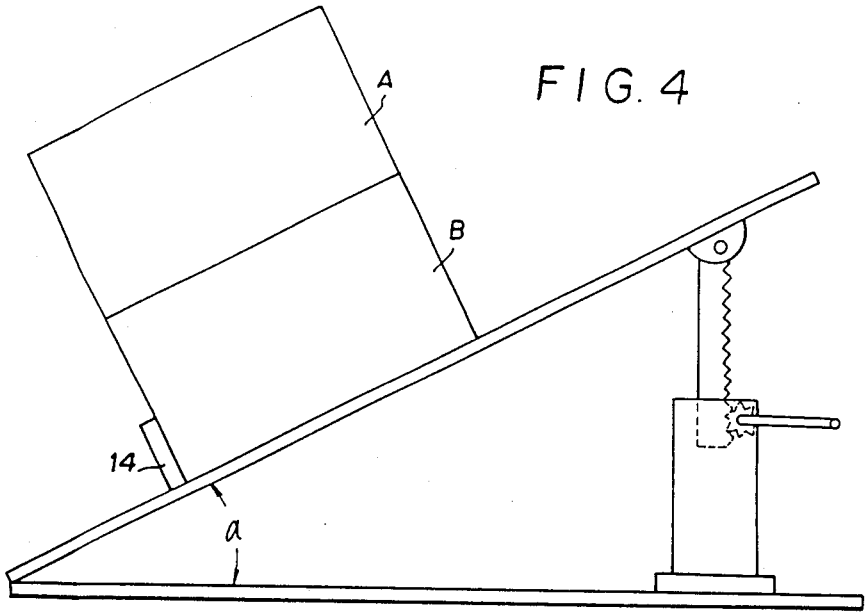
FIG. 4 is a side view showing an experimental method of measuring the anti-slipping effect of the cardboard container.

The cardboard containers (A) and (B) obtained from the above Examples in the same shape are stacked on an oblique surface as shown in FIG. 4, and the results measured for an angle ($\alpha$) that the upper container (A) starts slipping are shown in Table 1.

In FIG. 4, reference numeral 14 designates a stopper for preventing the lower container (B) from slidably dropping.

Figure 5:
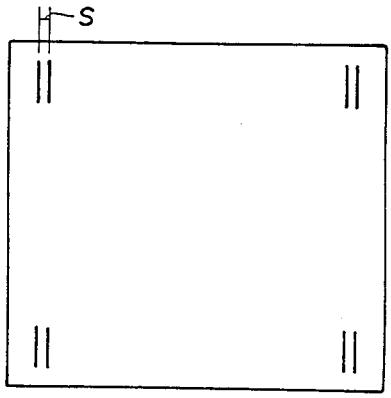
FIG. 5 is a plan view for describing the bonded position of an adhesive in case of bonding the container of upper side and the container of lower side with a hot melt adhesive in the container used in an experiment.

The container (a) of a reference product indicated in Table 1 is the ready made corrugated fiberboard box used in the above respective Examples, and the container (b) of reference product is formed by coating a hot melt type adhesive which mainly contains ethylene.vinyl acetate resin, wax and petroleum resin on the four corners of the top surface of the container (B) of the lower side of the ready made corrugated fiberboard box in the state shown in FIG. 5 in two strips having 40 mm of longitudinal size and 2 mm of lateral width in such a manner that the interval S from the center to the center of the strips is 20 mm by placing the ready made corrugated fiberboard box of the container (A) of the upper side while the coating agent is in a melted state and bonding fixedly the containers (A) and (B). The container (c) is formed by coating the ethylene.vinyl acetate resin emulsion on the entire top and bottom surfaces of the ready made corrugated fiberboard box at a rate of 3.5 g (solid content)/m$^2$, and dried at room temperature.

TABLE 1

| | No. | Types of Container | Stacked state | Angle ($\alpha$) |
|---|---|---|---|---|
| Container of embodiments | 1 | (I) | Top surfaces directed upward in stack | 50 |
| | 2 | (I) | STACK OF CONTAINERS USED IN NO. 1 collapsed and again stacked | 50 |
| | 3 | (II) | Top surfaces directed upward in stack | 35 |
| | 4 | (III) | Top surfaces directed upward in stack | 48 |
| | 5 | (IV) | Top surfaces directed upward in stack | 45 |
| | 6 | (V) | Top surfaces directed upward in stack | 30 |
| | 7 | (VI) | Top surfaces directed upward in stack | 50 |
| | 8 | (VII) | Top surfaces directed upward in stack | 48 |
| | 9 | (VII) | Stack of containers used in NO. 8 collapsed and again stacked | 47 |
| | 10 | (VIII) | Top surfaces directed upward in stack | 49 |
| | 11 | (IX) | Top surfaces directed upward in stack | 43 |
| Container of reference | 12 | (a) | Top surfaces directed upward in stack | 18 |
| | 13 | (b) | Top surfaces directed upward in stack | 25 |
| | 14 | (b) | Containers used in NO. 13 collapsed and again stacked | 18 |

TABLE 1-continued

| No. | Types of Container | Stacked state | Angle (α) |
|---|---|---|---|
| 15 | (c) | Top surfaces directed upward in stack | 35 |

From the results of the experiments shown in Table 1, the cardboard container of the embodiments according to this invention can confirm to not only provide excellent anti-slipping property in the cardboard container but also not to decrease and to continue the initial anti-slip property even if a plurality of stacked containers are disengaged and again stacked.

According to this invention as described above, there is provided a cardboard container such as a corrugated fiberboard box with anti-slip property having a body wall, a bottom wall and a top wall which comprises a synthetic resin layer formed of thermoplastic synthetic resin fine hollow particle group of 5 to 50 micron in diameter exhibiting an action of a binder, i.e., the surface of the synthetic resin layer for anti-slip formed of thermoplastic synthetic resin fine hollow particle group as an irregular surface, and the hollow particles of the synthetic resin layer for the anti-slip containing one or more of inert gas, active gas, nonvolatile liquid and volatile liquid coupled by synthetic resin component. Therefore, the synthetic resin layer for the anti-slip increases elastic property with high returning property to the original shape due to the presence of the fine hollow particles. Thus, the anti-slipping function of the synthetic resin layer is large, and even if the containers sealed with contents are stacked in any stages, the fine hollow particles of the synthetic resin layer are not compressed, and even if the stacked state is collapsed, and the containers are again stacked, the initial anti-slip property of the containers is not lost.

Further, the synthetic resin layer of the cardboard container with the anti-slip property for performing the anti-slipping function may be formed on any of the cardboard to be produced into box or of the surfaces of he container, and may be formed separately from the stacking work of the containers. Therefore, the operation is very simple.

In addition, the cardboard container which has the anti-slip property is formed with the synthetic resin layer exhibiting the anti-slip property as a transparent layer. Consequently, the design effect of the cardboard container is not lost, and the formation of the synthetic resin can be extremely readily carried out.

What is claimed is:

1. A cardboard container having a body wall, a bottom wall and a top wall, comprising:

a synthetic resin layer formed of thermoplastic synthetic resin fine hollow particles coupled with a synthetic resin component exhibiting the activity of a binder;

the thermoplastic synthetic resin fine hollow particles having a diameter of 5 to 50 microns and containing at least one of an inert gas, an active gas, a nonvolatile liquid and a volatile liquid;

the synthetic resin layer forming a film on at least a portion of the outer surface of at least one wall of the container.

2. A cardboard container according to claim 1, wherein the ratio of thermoplastic synthetic resin fine hollow particles to synthetic resin component exhibiting the activity of a binder ranges from 10:100 to 500:100 parts by weight.

3. A cardboard container according to claim 1, wherein said synthetic resin layer is formed on the entire outer surface of at least one of the bottom wall and the top wall.

4. A cardboard container according to claim 1, wherein said synthetic resin layer is formed on a portion of the outer surface of at least one of the bottom wall and the top wall.

5. A cardboard container according to claim 1, wherein said inert gas, active gas, nonvolatile liquid or volatile liquid are selected from a group consisting of ethane, ethylene, propane, butane, isobutane, butene, acetylene, heptane, chlorofluorocarbon, tetraalkylsilane, petroleum ether, water, nitrogen, and carbon dioxide.

6. A cardboard container according to claim 1, wherein the wall film formed of said thermoplastic synthetic resin fine hollow particle is selected from a group consisting of thermoplastic synthetic resin of polymer or copolymer such as vinylidene chloride, acrylonitrile, vinyl chloride, acrylic acid ester, methacrylic acid ester, styrene, and vinyl acetate.

7. A cardboard container according to claim 1, wherein the ratio of said synthetic resin component to the thermoplastic synthetic resin fine hollow particles is preferably 10 to 500 wt. parts of the fine hollow particles to 100 wt. parts of the synthetic resin component.

8. A cardboard container according to claim 1, wherein the wall film of said thermoplastic synthetic resin fine hollow particle is selected from a group consisting of thermoplastic synthetic resin of polymer or copolymer such as vinylidene chloride, acrylonitrile, vinyl chloride, acrylic acid ester, methacrylic acid ester, styrene, and vinyl acetate, and the content contained in said film is selected from a group consisting of ethane, ethylene, propane, butane, isobutane, butene, acetylene, heptane, chlorofluorocarbon, tetraalkylsilane, petroleum ether, water, nitrogen, and carbon dioxide.

9. A cardboard container with anti-slip property, comprising a coating agent containing water dispersant of 50 wt.% of solid component containing the following:

(1) 100 wt. parts of ethylene.vinylacetate copolymer emulsion (solid content)
Particle diameter: 0.7 micron
Nonvolatile content: 50%
Viscosity: 500 cps and (2) 100 wt. parts of fine hollow particles of vinylidene chloride
Content: butane
Diameter of particle: 10 to 20 micron coated on the entire top and bottom surfaces of a corrugated fiberboard box at a concentration of 3.5 g (solid content)/$m^2$, and dried at room temperature.

10. A cardboard container according to claim 1, wherein said synthetic resin component is selected from the group consisting of vinyl acetate resin, ethylene-vinyl acetate resin, acrylic resin, styrene resin, vinyl chloride resin, vinyl acetate acrylic resin, vinyl chloride-vinyl acetate resin, ethyleneacrylic resin, vinylidene chloride resin, polyester resin, polyurethane resin, chloroprene polymer, nitrile rubber, styrenebutadiene copolymer, and methacrylic-styrene copolymer.

* * * * *